US012194339B1

(12) United States Patent
Alnuaim et al.

(10) Patent No.: US 12,194,339 B1
(45) Date of Patent: Jan. 14, 2025

(54) AIRPLANE EXERCISE EQUIPMENT

(71) Applicant: KING FAISAL UNIVERSITY, Al-Ahsa (SA)

(72) Inventors: Anwar Alnuaim, Al-Ahsa (SA); Abdulaziz Alnuaim, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 31 days.

(21) Appl. No.: 18/543,850

(22) Filed: Dec. 18, 2023

(51) Int. Cl.

| | |
|---|---|
| ***A63B 22/20*** | (2006.01) |
| ***A63B 21/00*** | (2006.01) |
| ***A63B 21/04*** | (2006.01) |
| ***A63B 21/05*** | (2006.01) |
| ***A63B 22/00*** | (2006.01) |

(52) U.S. Cl.
CPC ..... *A63B 22/205* (2013.01); *A63B 21/0428* (2013.01); *A63B 21/05* (2013.01); *A63B 21/4034* (2015.10); *A63B 22/0012* (2013.01); *A63B 2022/0038* (2013.01); *A63B 2208/0233* (2013.01)

(58) Field of Classification Search
CPC . A63B 21/0428; A63B 21/05; A63B 21/4034; A63B 22/0012; A63B 22/205; A63B 2022/0038; A63B 2208/0233
See application file for complete search history.

(56) References Cited

U.S. PATENT DOCUMENTS

| | | | | |
|---|---|---|---|---|
| 3,754,547 | A | 8/1973 | Walker | |
| 4,645,200 | A | 2/1987 | Hix | |
| 5,499,958 | A * | 3/1996 | Hess | A63B 21/154 482/79 |
| 6,572,514 | B1 * | 6/2003 | Calafato | A63B 22/16 482/79 |
| 8,029,420 | B1 * | 10/2011 | Thati | A63B 22/0056 482/79 |
| 9,162,106 | B1 * | 10/2015 | Scheiman | A63B 21/0552 |
| 2009/0011906 | A1 | 1/2009 | Fernandez et al. | |
| 2011/0294633 | A1 * | 12/2011 | Esrick | A63B 21/0552 482/139 |
| 2018/0318639 | A1 * | 11/2018 | Kim | A63B 22/0046 |
| 2022/0355161 | A1 | 11/2022 | Polk et al. | |

* cited by examiner

*Primary Examiner* — Megan Anderson
(74) *Attorney, Agent, or Firm* — Nath, Goldberg & Meyer; Joshua B. Goldberg

(57) ABSTRACT

A method and portable device for facilitating physical exercise while traveling either by plane, train, bus, or other type of vehicular conveyance where the user is a seated passenger is provided. The method and device when used properly can effectively reduce foot/leg swelling associated with long seated periods of inactivity when traveling.

7 Claims, 1 Drawing Sheet

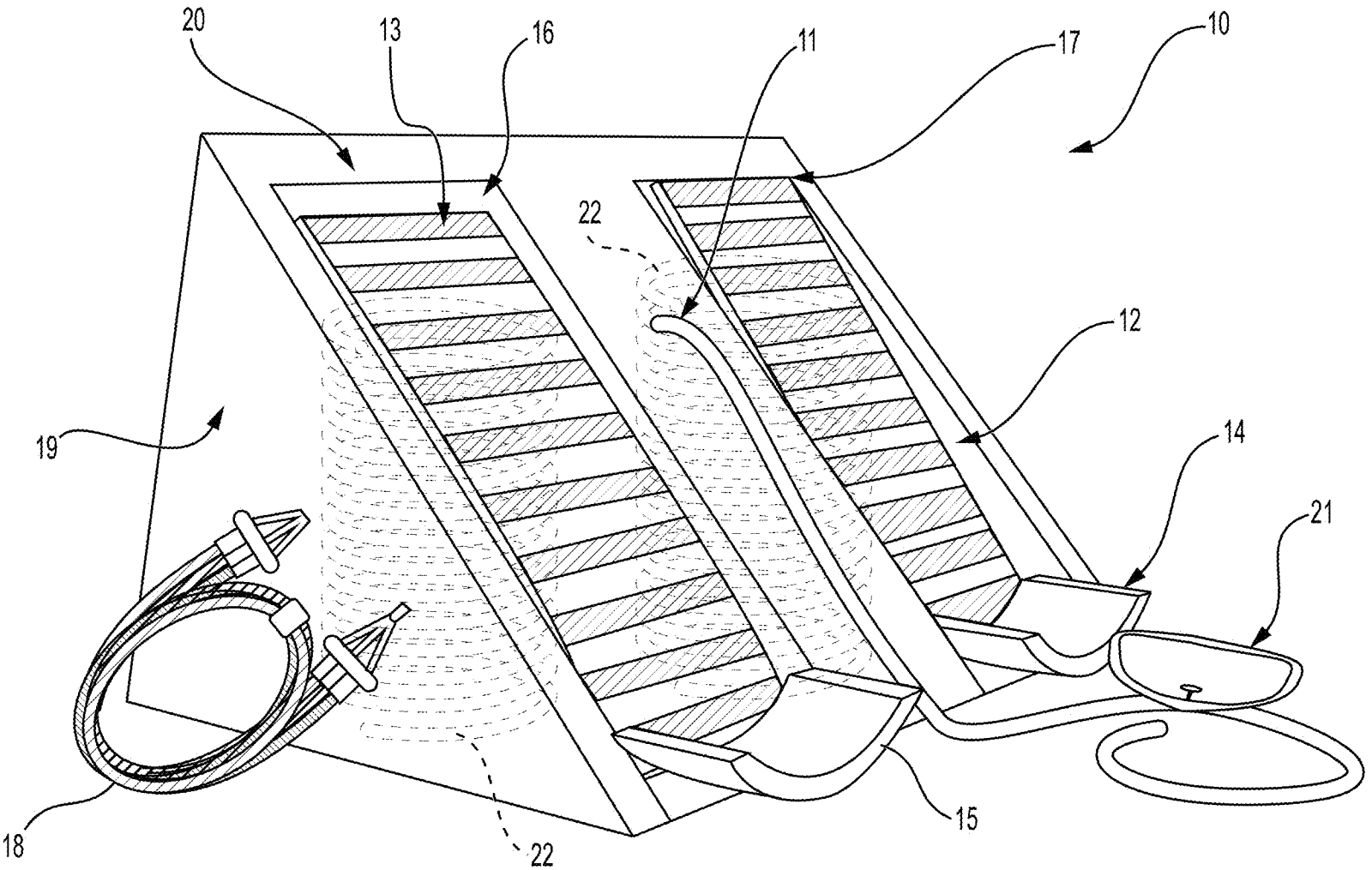
10
11
12
13
14
15
16
17
18
19
20
21
22
22

AIRPLANE EXERCISE EQUIPMENT

BACKGROUND

1. Field

The present disclosure relates to a method and portable device for facilitating physical exercise while traveling either by plane, train, bus, or other type of vehicular conveyance where the user is a seated passenger.

2. Description of the Related Art

During travel over a great distance or duration, one is confined to a seated position for a majority of the trip. This period of seated inactivity can lead to swelling either in the legs or feet of the seated traveler due to the overflowing of blood in the veins of one's legs and feet. Furthermore, it is noted that the position or orientation of one's legs when seated can also increase the pressure in the veins in one's legs, which can contribute to swelling by causing fluid to leave the blood and accumulate in the surrounding soft tissue. Doctors prescribe whenever possible during such instances of travel getting up and walking for brief periods of time or if that is not possible exercising while seated in order to prevent these unwanted side effects and health concerns. In addition to reducing swelling in one's legs during long instances of seated travel, there are specific medical concerns to be addressed regarding rheumatoid arthritis where the symptoms are prevalent in the legs, pain and discomfort associated with varicose veins, and restless leg syndrome.

What is needed is a method and device for allowing seated passengers to exercise their legs and feet while remaining seated during long durations of travel in airplanes, buses, or trains such that restricted leg and foot activity doesn't lead to excessive swelling in the legs, or further complications from medical conditions such as rheumatoid arthritis where the symptoms are prevalent in the legs, pain and discomfort associated with varicose veins.

SUMMARY

The present subject matter is directed towards a method and device for facilitating physical exercise while traveling either by plane, train, bus, or other type of vehicular conveyance where the user is a seated passenger.

In a first aspect of the present subject matter, a device is provided that the user can place at their feet between the rows of seats of either a commercial airplane, bus, train, or other vehicular conveyance of mass transit where the passengers travel in a parallel array of seated rows, wherein the device when placed at an optimal location at the feet of the user allows the user to place their feet on two pedals residing in a front face of said device, and whereby applying pressure to each of the two pedals with the user's feet is able to exercise said user's legs and thus improve circulation in the user's legs.

A second aspect of the present subject matter is the method which when implemented with the device improves the circulation of the user's legs and helps to reduce the swelling of the user's legs while the user is seated for a long duration of travel.

These and other features of the present subject matter will become readily apparent upon further review of the following specification.

BRIEF DESCRIPTION OF THE DRAWINGS

FIG. 1 is a diagram of the exercise device for a seated passenger.

DETAILED DESCRIPTION OF EMBODIMENTS

The following definitions are provided for the purpose of understanding the present subject matter and for construing the appended patent claims.

Definitions

It should be understood that the drawings described above or below are for illustration purposes only. The drawings are not necessarily to scale, with emphasis generally being placed upon illustrating the principles of the present teachings. The drawings are not intended to limit the scope of the present teachings in any way.

Throughout the application, where products are described as having, including, or comprising specific elements, or where processes are described as having, including, or comprising specific process steps, it is contemplated that products of the present teachings can also consist essentially of, or consist of, the recited elements, and that the processes of the present teachings can also consist essentially of, or consist of, the recited process steps.

It is noted that, as used in this specification and the appended claims, the singular forms "a", "an", and "the" include plural references unless the context clearly dictates otherwise. The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Throughout the application, descriptions of various embodiments use "comprising" language. However, it will be understood by one of skill in the art, that in some specific instances, an embodiment can alternatively be described using the language "consisting essentially of" or "consisting of".

As shown in FIG. 1, in an exemplary embodiment, the exercise device (10) can be a prism forming with three rectangular faces, including a rectangular front face (20), a rectangular rear face, and a rectangular bottom face. The device can further include two scalene triangular faces, a left side scalene triangular face (19) and a right side scalene triangular face. In an embodiment, the rectangular front face (20) can be about 40 cm across by about 41.25 cm up. In another embodiment, the rear rectangular face can be about 40 cm across by about 26 cm up. In a further embodiment, the rectangular bottom face can be about 40 cm across by about 32 cm wide. The left (19) and right scalene triangular side faces can each be dimensioned with a base of about 32 cm, a height of about 26 cm, and a third side of about 41.25 cm.

In an embodiment, the housing of the prism shaped device (10) and a majority of its components unless specifically stated otherwise can be made of a durable yet lightweight plastic. However, the durable yet lightweight plastic could be replaced by other materials such as molded resins, polymers, copolymers, fiberglass, and the like as long as they maintain the portability of the device while providing it with structural integrity.

The dimensions of the prism can be optimally chosen so that the prism (10) can be installed at a user's feet between the space provided between parallel rows of passenger seating, for example, in a vehicle. Currently, for example, most commercial airlines size their seating configurations in accordance with FAA standards/guidelines such that a seat pitch between individual rows of seats have an average distance of 32.1 inches or 81.534 cm, where the seat pitch is a distance measured from a user's seat back to the seat back directly facing the user. These same FAA standards/guidelines set the width of an average passenger seat in a commercial airline to be currently sized at 17.7 inches or 44.96 cm. As such, the sizing on the prism can be chosen such that it can be easily accommodated by current legroom and seat pitch standards/guidelines.

In use in the non-limiting embodiment of airplane travel, the user would wait until the plane has leveled off, the seat-belt sign has been turned off, and the captain has given the word that it is safe to move about the aircraft, to remove the prism (10) from the overhead compartment or extricate it from the under the storage in the seat directly in front of the passenger's seat. The user could then position the prism (10) in a comfortable position such that their feet could rest upon the rectangular front face (20). Specifically, the user could place one foot on a left pedal (13) and the other foot on a right pedal (17).

As shown in FIG. 1, the left pedal (13) rests in a left cavity (16) of the rectangular front face (20) of the prism (10) and the underside of the left pedal (13) is attached to the bottom of the left cavity (16) with a compressible spring (22) that provides resistance against a downward force pushing the left pedal (13) into the cavity's recess. The right pedal (17) rests in a right cavity (12) and operates in a correspondingly identical manner to the left pedal (13) as the right pedal has its own compressible spring (22) that provides resistance against a downward force that would push the right pedal (17) deeper into the right cavity's (12) recess. Both the left cavity (16) and the right cavity (12) can be sized to be about 32 cm long and about 12 cm wide, and the left pedal (13) and right pedal (17) can be sized to be accommodated by each respective cavity (16), (12).

In an embodiment, the compressible springs (22) could each be replaced by a fulcrum mechanism such that instead of resistance being provided, the device is configured to improve the ankle flexibility of the user as the downward force would be replaced by the user rocking each foot back and forth at the ankle over the upper surface of each of the pedals (13), (17). At the bottom or heel end of each pedal (13), (17) are mounted respective arcuate foot/heel braces (15), (14) which serve to keep the foot squarely upon the active surface of each pedal (13), (17). Each arcuate foot/heel brace (15), (14) can be sized to be about 3 cm from the front curve to the back curve.

An additional feature of the prism (10) is an attachment point (11) on the rectangular front face (20) of the prism (10) for an arm band located at a midpoint between the left cavity (16) and the right cavity (12). The arm band can be a rubber rope or string (18) that provides resistance training when pulled by the seated passenger and can have an attachable handle (21) for gripping purposes. This is an added benefit of providing an additional option for reducing physical inactivity during long durations of seated passenger travel. The prism actually has three such interchangeable ropes (18), each providing the user with varying degrees of resistance at the arm band attachment point (11). Further, the three ropes (18) can be put away together when the device is not in use and stowed back during landing. The prism (10) can also come with a carrying bag (not shown) such that it can be transported easily while the passenger is traveling.

It is to be understood that the method and portable device for facilitating physical exercise while traveling is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A portable device for facilitating physical exercise while traveling on a plane, bus, or train, comprising:

a prism housing comprising:
- a rectangular front face;
- a rectangular rear face:
- a rectangular bottom face;
- a left side scalene triangular face;
- a right side scalene triangular face;
- a left cavity in said rectangular front face; and
- a right cavity in said rectangular front face;

a left foot pedal;

a right foot pedal;

an attachment point for an armband, wherein said attachment point for said armband is located on said rectangular front face between a midpoint of said left cavity in said rectangular front face and said right cavity in said rectangular front face; and an armband with a handle.

2. The portable device for facilitating physical exercise while traveling on a plane, bus, or train as recited in claim 1, where said left foot pedal resides in said left cavity and said right foot pedal resides in said right cavity.

3. The portable device for facilitating physical exercise while traveling on a plane, bus, or train as recited in claim 2, wherein an underside of said left foot pedal is attached to a surface of said left cavity by a first compressible spring and an underside of said right foot pedal is attached to a surface of said right cavity by a second compressible spring.

4. The portable device for facilitating physical exercise while traveling on a plane, bus, or train as recited in claim 3, wherein said first compressible spring and said second compressible spring each provide a respective resistance when respectively acted upon by respective downward forces.

5. The portable device for facilitating physical exercise while traveling on a plane, bus, or train as recited in claim 4, wherein said respective downward forces are configured to be provided by respective downward movements of a user's left and right foot.

6. The portable device for facilitating physical exercise while traveling on a plane, bus, or train as recited in claim 1, wherein said left foot pedal has an arcuate foot/heel brace mounted to a bottom of said left foot pedal and said right foot pedal has an arcuate foot/heel brace mounted to a bottom of said right foot pedal.

7. A method for reducing foot/leg swelling while using the portable device of claim 1, comprising:

having a user positioning the portable device at the user's feet while said user remains seated;

placing a user's left foot on the left foot pedal of the portable device and a user's right foot on the right foot pedal of the portable device while said user remains seated;

using said left foot of said user to apply a first downward force to said left foot pedal and using said right foot of said user to apply a second downward force to said right foot pedal; and repeating said applying said first downward force and said second downward force to improve the blood circulation and reduce the swelling in said left foot and said right foot of said user.

* * * * *